United States Patent [19]

Mattingly et al.

[11] Patent Number: 4,955,474

[45] **Date of Patent: * Sep. 11, 1990**

[54] WATER HEATER PACKAGE CONSTRUCTION

[75] Inventors: Bruce W. Mattingly, Louisville; Roger J. Coates, Cox's Creek, both of Ky.

[73] Assignee: Soltech, Inc., Shelbyville, Ky.

[ * ] Notice: The portion of the term of this patent subsequent to Nov. 21, 2006 has been disclaimed.

[21] Appl. No.: 367,764

[22] Filed: Jun. 19, 1989

Related U.S. Application Data

[63] Continuation of Ser. No. 307,322, Feb. 6, 1989.

[51] Int. Cl.[5] ..... B65D 85/30

[52] U.S. Cl. ..... 206/320

[58] Field of Search ..... 206/320

[56] References Cited

U.S. PATENT DOCUMENTS

| | | | |
|---|---|---|---|
| Re. 25,605 | 6/1964 | Stuckert | 206/320 |
| 2,321,063 | 6/1943 | Bohnke | 206/320 |
| 2,370,749 | 3/1945 | Perkins | 206/320 |
| 2,932,438 | 4/1960 | Smith | 206/320 |
| 2,936,880 | 5/1960 | Kohlhaas | 206/320 |
| 3,363,749 | 1/1968 | Tinapple | 206/320 |
| 3,669,255 | 6/1972 | Raymus | 206/397 |
| 3,685,644 | 8/1972 | Cothran et al. | 206/408 |
| 3,835,986 | 9/1974 | LeBeau | 206/320 |
| 3,891,086 | 6/1975 | Isaacs | 206/320 |
| 4,019,672 | 4/1977 | Giannini | 206/320 |
| 4,226,327 | 10/1980 | Ballard | 206/320 |
| 4,398,212 | 8/1983 | Serry et al. | 206/320 |
| 4,408,689 | 10/1983 | Daniels | 206/320 |
| 4,545,482 | 10/1985 | Novatny | 206/320 |
| 4,666,749 | 5/1987 | McCurry et al. | 206/408 |
| 4,811,840 | 3/1989 | Muyskens | 206/320 |

*Primary Examiner*—William J. Price

*Attorney, Agent, or Firm*—Woodard, Emhardt, Naughton, Moriarty & McNett

[57] ABSTRACT

A composite package for a water heater includes a two-part folded cardboard assembly as a top support panel and a two-part folded cardboard assembly as a bottom support panel. The two members that comprise the top support panel each being as a generally rectangular cardboard member which is folded so as to result in a double-thickness center area and oppositely disposed downwardly depending side walls. These two members are then turned 90 degrees to each other so as to create an open, box-like structure. Virtually the same procedure is followed for the fabrication of the bottom support panel. Each of the four folded cardboard members include a centrally disposed and generally rectangular reinforcement which may either be plastic, metal or a similar relatively rigid material and this reinforcement is secured to the folded cardboard. After the water heater is placed within the bottom support panel and the top support panel is attached to the top of the water heater, bands are arranged around the entirety of the assembly and tightened so as to draw the top and bottom support panels toward one another and against the opposite ends of the water heater. For added bracing and support, corner braces are installed in the corners of the bottom support panel so as to be contiguous with the outer surface of the water heater.

5 Claims, 3 Drawing Sheets

WATER HEATER PACKAGE CONSTRUCTION

This application is a continuation of application Ser. No. 307,322, filed Feb. 6, 1989.

BACKGROUND OF THE INVENTION

The present invention relates in general to packaging designs and concepts for appliances and more particularly to packaging designs and concepts for water heaters.

Currently, appliances which are shipped from the manufacturer to the distributor or retail store are packaged in cardboard (corrugated) containers with presumably enough internal support, insulation and bracing to minimize the risk of damage to the appliance if the box takes a hit or impact of some fashion. In order to provide enough internal space for the required supports, insulation and bracing, the box must be made several inches oversized on all sides. The result of incorporating this additional clearance space is a more expensive package in terms of material costs, and a larger package which frequently results in higher shipping costs. As would be expected, even though the increased size of the package may only be a few inches, it results in fewer packages per truckload and the shipping cost per appliance increases.

Another aspect of corrugated cardboard containers of the type generally used for appliances is the time required to assemble the container, install the appliance, and complete the packaging with all of the required interior supports, insulation and braces. The fact that such packaging is labor intensive adds further to the overall cost.

Finally, it is desirable to be able to see the article within the container so that if damage does occur during any shipping or handling phase, the shipper, distributor or other end user is alerted to the damage and can assess the situation and proceed accordingly. The advantage of a see-through or partial see-through container is that visual inspection can be made prior to shipment, or at any time during transport of the appliance. If the damage is severe enough, the appliance can be returned to the manufacturer without incurring further shipping and handling costs. The risk of forwarding on a damaged appliance when that damage is discovered early in the cycle is that it will likely be rejected and returned by the distributor or end user to the manufacturer. If the damage occurs later in the routing, the distributor or store can recognize the problem before the appliance is delivered to the customer who would surely reject the delivery if the damage is severe enough. Although not always a factor due to container shapes and configurations, a see-through package helps to better identify the article being shipped and gives the shipper or handler a better grasp of how to move and stack the article.

Water heaters present a particularly unique packaging and shipping problem due to their top-heavy nature. There is a greater likelihood for a water heater to tip over in transit than virtually any other appliance. If the top of the unit is set in motion, even slight momentum can be disastrous. Consequently, it is important to package water heaters such that the water heater is extremely secure and stable so that the top of the unit can be rigidly attached and secured to the surrounding package in hopes of precluding even slight movement which can increase the risk that the entire water heater will tip over.

While packaging for water heaters must be carefully and precisely designed, there a number of packaging concepts which have been conceived over the years. While some of these concepts are unique to water heater construction, others have more general applicability. The following references all disclose packaging concepts and designs, and most utilize corrugated cardboard in some fashion and many are directed specifically to the packaging of water heaters. These references include:

| Patent No. | Patentee | Issue Date |
|---|---|---|
| 4,226,327 | Ballard | 10/07/1980 |
| 3,835,986 | LeBeau | 09/17/1974 |
| 2,932,438 | Smith | 04/12/1960 |
| 4,398,212 | Serry | 08/09/1983 |
| 4,408,689 | Daniels | 10/11/1983 |
| 4,545,482 | Novatny | 10/08/1985 |
| 4,019,672 | Giannini | 04/26/1977 |
| 2,936,880 | Kohlhaas | 05/17/1960 |
| Re. 25,605 | Stuckert | 06/23/1964 |
| 2,321,063 | Bohnke | 06/08/1943 |
| 4,666,749 | McCurry | 05/19/1987 |
| 3,685,644 | Cothran | 08/22/1972 |
| 3,669,255 | Raymus | 06/13/1972 |

Ballard discloses a shipping package designed for appliances including a support portion made from corrugated fiberboard which is arranged so as to cover the top and at least one side of the appliance. This corrugated fiberboard covering is secured to the appliance by encircling bands and a shrink film plastic is disposed so as to cover the support portion and the appliance in order to form an integral part of the support structure of the package. The support portion begins as a substantially flat member having a series of flanges and panels and predetermined fold lines so as to enable the support portion to be contoured for the particular appliance.

LeBeau discloses a composite package for enclosing a cylindrically shaped object such as a water heater. Substantially rectangular end members are provided and include generally cylindrical locating depressions which are intended to receive the ends of the cylindrical object. A substantially rectangular intermediate member with a circular center opening encircles an intermediate portion of the cylindrical object. Four elongated reinforcing members are positioned around the edges or four corners of the package and are configured to engage locating notches which are formed at the corners of the intermediate member. A bi-axially oriented heat-shrunk synthetic transparent film is extended externally around the end, intermediate and reinforcing members to hold such members in assembled relation and protect the cylindrical object while permitting visual inspection thereof. Due to the use of the corner members and the general design of the top and bottom panels, this particular packaging concept cannot be regarded as "zero clearance" and thus involves the aforementioned deficiency of increased package size in order to provide the requisite space for support, insulation and internal bracing. As one example, the oversized nature of the intermediate member as illustrated in FIG. 2 results because a certain material or wall thickness is needed along the center of each side of the intermediate member in order to provide the requisite strength or bracing.

Smith discloses a paperboard shipping container for a water heater which includes top and bottom members which are strengthened by providing a plurality of paperboard thicknesses. The shipping container is completed by a lower end member disposed exterior to the bottom support thickness and a cover which is disposed exterior to the top support member. Finally, an encircling and enclosing four-sided cardboard panel is provided and the upper lip of this four-sided member fits within the cover and the lower lip fits within the bottom panel. The assembly is completed by tightening a top and bottom band around the cover and base so as to secure that member to the four-sided enclosing wall member. Although clearance holes are provided in the top support and in the base support for the pipes, flue and legs, respectively, this particular packaging concept does not represent a zero clearance design nor does it represent a design which has the necessary economies of mass production. The number of members which must be specially formed and contoured and the number of steps to complete the packaging are excessive and would not be acceptable for current production demands.

Serry discloses a shipping container for a closed-circuit television system which includes a box for housing an operatively connected closed-circuit television. A packaging means holds the monitor and camera oriented within the box so that the lens of the camera and the screen of the monitor face the front end of the box. The packaging means also holds the camera and monitor such that the lens can be focused and picture controls on the monitor adjusted by accessing the same through the front end. A power cord for connecting the system to an external power source is also accessible from the front end. Upon applying power, the monitor will display the view from the front end of the box as seen by the camera therein testing the system while still in the shipping container.

Daniels discloses a package construction for floor display merchandise, such as a water heater. The package includes instructions as to how certain panels are to be cut and folded using appropriate bending means without damaging the structural integrity of the panels. When these panels are bent open, a portion of the interior of the panel as well as the merchandise inside is exposed to view. The package also includes a clip which is used to secure the bent panels in their open position. While this particular patent discloses a very specialized merchandise display container, the example used is of a water heater and with regard to that packaging concept, it is believed to be conventional in virtually all other respects, including a top panel, a bottom panel and a four-sided enclosing box typical of the prior systems the present invention improves upon.

Novatny discloses a support pad formed from a pair of corresponding horizontal, vertically spaced rectangular blanks, each of which are divided by a pair of parallel fold lines into a center panel and a pair of side wall panels. The blanks are joined by a pair of spacer members adhesively bonded between corresponding side wall panels of the blanks. The center panel of one blank contains the line of severance parallel with the fold lines and cut-out portions on opposite sides of the line of severance that define sets of corresponding dovetail projections in grooves. The relative distances between the fold lines, the height of the dovetail projections, and the combined thickness of the spacer members are such that when the side wall assembly is defined by the bonded side wall panels and spacer members are folded upwardly to vertical positions relative to the bottom center panel, the dovetail projections may be brought manually into interlocking engagement with the corresponding grooves thereby to maintain the side wall assemblies in the vertical position.

Giannini discloses a packaging insert which is formed from a blank of foldable sheet material and is adapted to be disposed within a multi-sided container in order to position a product in a predetermined relation within the container material. The insert includes a base panel having a peripheral configuration conforming substantially to the area defined by the side walls of the container. Foldably connected to the periphery of the base panel disposed adjacent to predetermined corners thereof are a plurality of support units. Each unit has a first section thereof which overlies the surface of the base panel and a second section which projects therefrom. Each support unit is held in a set-up condition by an elongated retainer member which is struck out from the base panel.

Kohlhaas discloses a positioning and retaining member which may be used for bracing the top circumference of a water heater and includes a substantially square cardboard frame and interior thereto a generally cylindrical wall which is formed by a plurality of folded tabs. The entire positioning and retaining member may be fabricated from a flat fiberboard sheet with corner notch relief so that side flaps can be folded up or down so as to provide an enclosing top member of a generally square shape having a predetermined wall thickness. By cutting through the cardboard retaining member with a generally circular shape and then along evenly spaced radial lines cutting between individual tabs, these tabs can be folded either upwardly or downwardly so as to create a generally cylindrical recess for retention of the generally cylindrical water heater.

Stuckert discloses a spacer insert for a container which begins as a substantially flat sheet of fiberboard having a plurality of cut lines, score lines for folding, notches and flanges, all of which permit the substantially flat member to be repetitively folded. The resultant structure is a relatively stiff and generally square support panel having four side walls and a generally cylindrical center portion which is used in combination with the water heater for support and bracing.

Bohnke discloses a packaging box for an appliance such as a water heater wherein multiple thicknesses of fiberboard are arranged so as to support, insulate and brace the top of the water heater as well as the base, the base being arranged with relief for the legs of the water heater.

McCurry discloses an end support panel for supporting rolls of web-like material wound on a cylindrical core. The panel includes a rigid panel member having an aperture extending laterally therethrough and a covering of heat-stretchable, heat-shrinkable plastic film extending entirely over one end of the panel member around the edges of its periphery and aperture and over a first zone and a second zone on the other side of the panel member. The first zone extends inwardly from the panel periphery and the second zone extends outwardly from the panel aperture. The covering film is heated and then vacuum stretched to conform to the shape of the panel periphery and the aperture perimeter.

Cothran discloses an end suspension support panel for use in packaging rolls of material such as plastic film on cylindrical cores. The panel has a layer of cushioning material over one side of the panel and the entire panel is shrink-wrapped in plastic film.

Raymus discloses an end-capped cylindrical package wherein end caps are first placed on one or both ends of the cylindrical object, particularly a roll of sheeting material and the thus capped cylindrical object is then enveloped in a heat-shrinkable plastic film.

Although the foregoing packaging concepts and designs provide a wide variety of options and alternatives, none of the references, either singularly or in combination anticipate or render obvious the present invention. The present invention employs a uniquely structured pair of reinforcing panels as part of a folded, corrugated, cardboard top member for the packaging of a water heater. With these reinforcing panels turned at 90 degrees to each other, they are provided with clearance holes which receive threaded plugs which in turn are received by the internally threaded outlets in the top of the water heater. Gaskets around the clearance holes are disposed between the top surface of the water heater and the lower inside surface of the adjacent panel. A similarly configured bottom member is provided also with a pair of reinforcing panels, though without the clearance holes. Additional bracing and strength for the bottom member is provided by styrene or similar plastic wedges which are applied at each corner in order to align and brace the lower portion of the water heater. These corner wedges may also be constructed as a corrugated build-up or a vacuum-formed member.

If the water heater is configured with some type of support or legs, the corner wedges are notched in order to trap and secure the supports or legs to help keep the water heater from rotating within the package. By securing the top and bottom member together with tightened top to bottom girth bands, the heavier top end of the water heater is held securely, minimizing if not eliminating any motion and reducing the chances of the water heater tipping over. An added advantage of this packaging concept is the ease, simplicity and low cost due to the minimal steps required and relatively basic shapes involved to complete the packaging concept. Automation is possible due to the ease and simplicity of the present invention. The entire assembly can be protected from dirt and debris by heat-shrinkable plastic wrap or by stretch wrap. The design is basically generic and thus can be standardized for a majority of currently manufactured water heaters. Nevertheless, specialized designs are easily made and conversions can be accomplished quickly as designs change. The "zero clearance" approach of the present invention reduces packaging size and thus packaging costs both as to the material expenditures and the shipping expenses.

SUMMARY OF THE INVENTION

A composite package for appliances and the like according to one embodiment of the present invention comprises a top support including first member having a reinforcing panel and a second member having a reinforcing panel, the reinforcing panels arranged in an overlapping relationship to each other; a bottom support including a first member having a reinforcing panel and a second member having a reinforcing panel, the reinforcing panels arranged in an overlapping relationship to each other; attachment means for attaching the top support to the appliance received within the composite package and securement means for securing together in a stacked relationship the top and bottom supports with the appliance therebetween.

One object of the present invention is to provide an improved composite package for appliances.

Related objects and advantages of the present invention will be apparent from the following description.

DESCRIPTION OF THE PREFERRED EMBODIMENT

Figure 1:
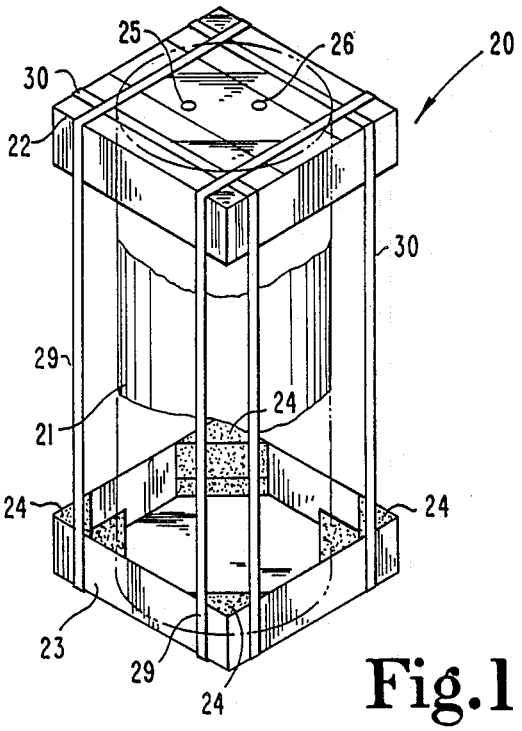
FIG. 1 is a perspective view of a composite package disposed about a water heater according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a composite package 20 illustrated in perspective view form and disposed about an appliance, in the preferred embodiment, a water heater 21. Composite package 20 includes a top support 22, a bottom support 23, corner supports 24, and a pair of externally threaded plugs 25 and 26 which are used to secure the top support 22 to the internally threaded openings in the top of water heater 21. Composite package 20 also includes an arrangement of four bands 29 and 30 which extend completely around the top and bottom supports and are tightened so as to draw the top and bottom supports together with the water heater 21 disposed therebetween. Bands 29 and 30 may be either metal or plastic or the "bands" may actually be wires. This securement by means of bands 29 and 30 rigidly holds both the top support and the bottom support against their respective ends of water heater 21 and in effect locks them in fixed relation to each other. This securement by means of bands 29 and 30 is in addition to the bracing and support provided by corner supports 24 and the attachment by plugs 25 and 26.

As is illustrated, two bands 29 extend in a first direction around top and bottom supports 22 and 23, respectively, adjacent the outer edges of each support as well as adjacent the outer circumferential edge of the water heater and the two bands are configured so as to be substantially parallel to each other along all four faces of composite package 20. The other two bands 30 are similarly arranged relative to the other two sides of composite package 20 and likewise extend completely around both top and bottom supports and are likewise arranged so as to be adjacent the outer edges of the two supports as well as the water heater 21. Bands 30 are also arranged so as to be substantially parallel to each other along all four faces of package 20 and further are configured so as to run in a direction substantially perpendicular to the direction of bands 29. Consequently, in the vicinity of each corner of both the top support 22 and the bottom support 23, bands 29 and 30 overlap and cross each other with a substantially perpendicular, overlapping intersection. It is also envisioned that a suitable alternative to the illustrated arrangement of bands 29 and 30 is to square off the corners of the top and bottom supports 22 and 23 and diagonally crisscross the bands. If one pair of bands are diagonal, the other pair may be wrapped in the center and crossed.

Figure 6:
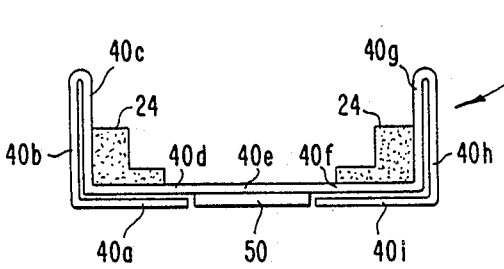
FIG. 6 is a front elevational view of one of the bottom support members as folded prior to assembly into the composite package of FIG. 1.

As will be described in greater detail hereinafter, corner supports 24 are specifically contoured triangular blocks or wedges of synthetic material such as styrene or urethane and are sized so as to fit snugly in each corner of the open, box-like structure of bottom support 23. Each of the corner supports 24 may also be fabricated as a corrugated build-up or as a vacuum-formed member. The inwardly facing surface of each corner support 24, the face directed toward the outer surface of water heater 21, is sized and contoured so as to fit snugly up against and beneath the outer cylindrical surface of water heater 21 thereby supporting and bracing that portion of the heater relative to bottom support 23. In the preferred embodiment of the present invention, corner supports 24 are configured with a lower, inwardly directed shelf as illustrated in FIG. 6 so as to provide underside support and cushioning for water heater 21 and to locate the legs in order to prevent rotation. As illustrated, the inwardly directed shelf of each corner support 24 extends beneath the bottom surface of water heater 21 and results in a stand-off configuration lifting the lower or bottom surface of the water heater up off of the top inner surface of bottom support 23. It is also to be understood that the supports 24 can be arranged as squarees or rectangles (actually cubes or rectangular solids) and positioned along the sides of the bottom support in lieu of the corners. While such side supports would most likely be used with gas water heaters in order to provide corner clearance for the gas controls, the key is to adapt the supports to the specific geometry of the heater in order to provide rigid support.

Figure 2:
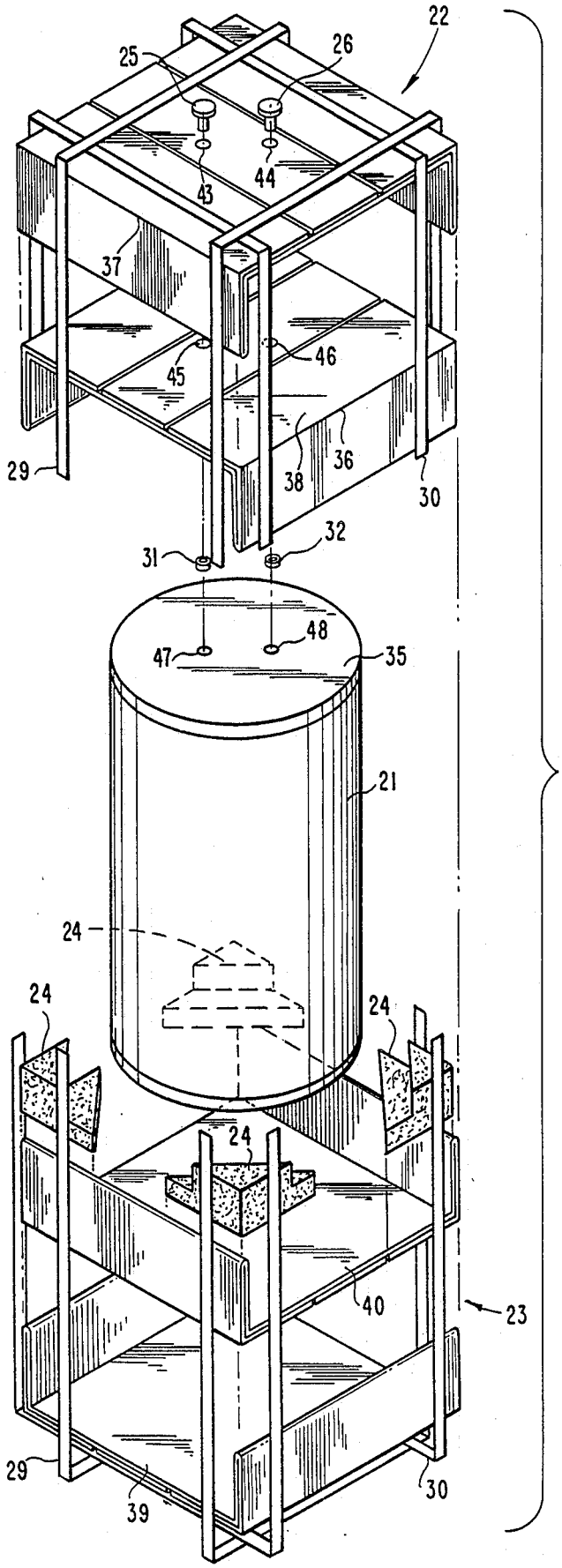
FIG. 2 is an exploded view of the FIG. 1 composite package as assembled and disposed about the FIG. 1 water heater.

Referring to FIG. 2, the composite package 20 and water heater 21 arrangement of FIG. 1 is illustrated as an exploded view. Each of the aforementioned components of composite package 20 are illustrated. Of particular note with regard to the exploded view arrangement is the two-part construction of top support 22 and the two-part construction of bottom support 23. As is illustrated, the corner supports 24 are styled so as to provide the lower inwardly directed shelf for cushioning the undersurface of water heater 21. Also to be noted is that a pair of gaskets 31 and 32 are disposed between the top surface 35 of water heater 21 and the lower or bottom surface 36 of top support 22. Of particular interest with regard to the exploded view form of FIG. 2 is the configuration of first member 37 and second member 38 of top support 22 and the manner in which they are folded and overlay one another so as to create top support 22. A similar construction exists for bottom support 23 wherein first member 39 is folded in a particular fashion as is second member 40 and then assembled in a crossed and overlapping manner.

The first and second members of top support 22 and the first and second members of bottom support 23 are each fabricated from an initially flat sheet of corrugated cardboard or fiberboard. With this type of material, the corrugations all longitudinally extend in the same direction and thus corrugated cardboard material may be thought of as having a particular grain or grain direction. Each of the folds which are made in the first and second members of each support are made along fold lines which are substantially perpendicular to the longitudinal direction of the corrugations. However, each member is folded in a manner so as to result in a generally square top panel and two substantially parallel and opposite side portions which depend downwardly from the center panel in the case of support 22 and the oppositely disposed sides extend upwardly from the center panel in the case of support 23. Consequently, by turning the first and second members of support 22 at right angles to each other after the folding operation, what is created is in effect a five-sided open box with the base or center wall of the box being created by the two center panels of the first and second members and the four sides of this box being created by the depending side walls of each member. While this particular configuration is believed to be adequately illustrated by FIGS. 1 and 2, the folded configuration of supports 22 and 23 is further illustrated in FIGS. 5 and 6, respectively, which illustrate the double thickness of the side walls for the first and second members as a result of the folding in a manner illustrated in FIG. 2 and further defined in FIGS. 3 and 4.

Figure 5:
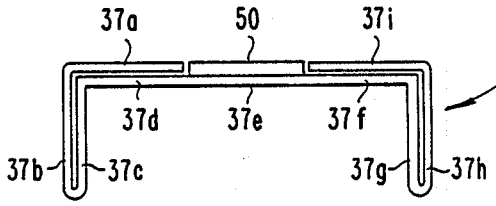
FIG. 5 is a front elevational view of one of the two top support members as folded for the assembly into the composite package of FIG. 1.
Figure 3:
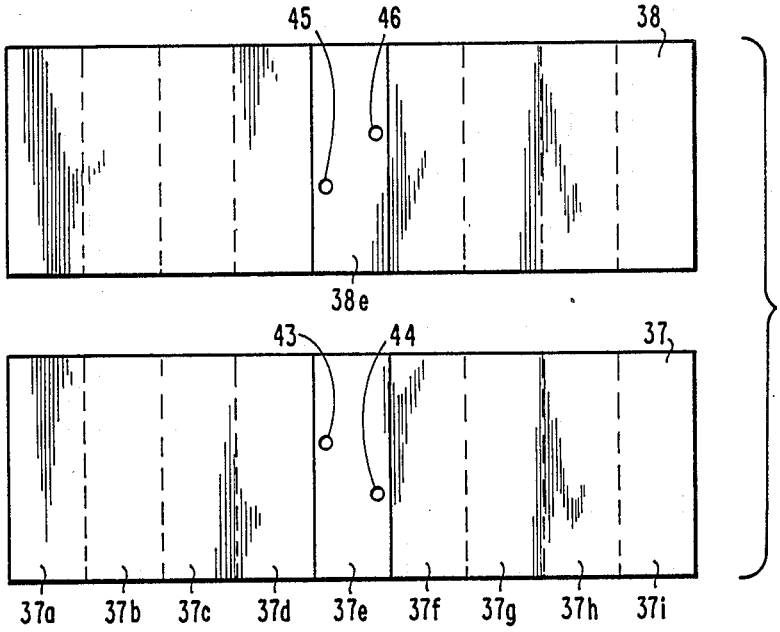
FIG. 3 is a top plan view of the two top support members as configured prior to folding and assembly into the FIG. 1 composite package.
Figure 4:
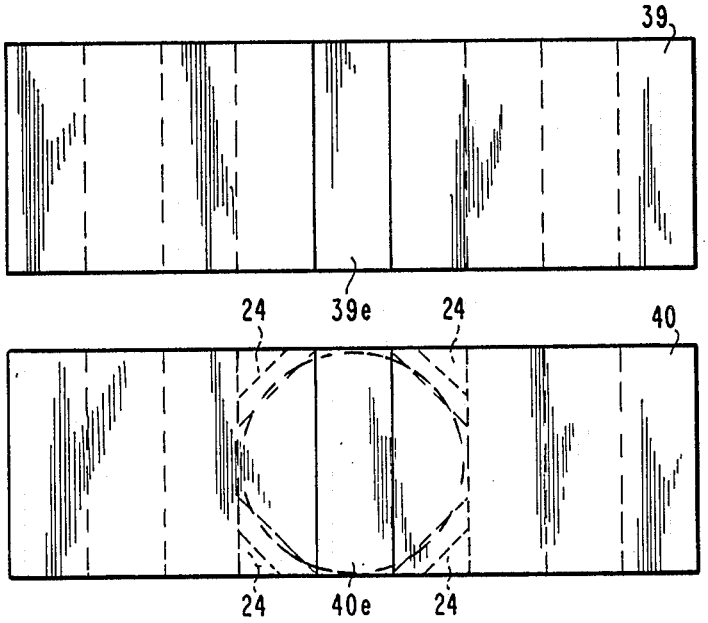
FIG. 4 is a top plan view of the two bottom support members as configured prior to folding and assembly into the FIG. 1 composite package.

Referring to FIGS. 3 and 4, the first and second members of top and bottom supports are illustrated. Although the size, shape and construction of these four members is virtually identical, each one has been illustrated due to certain variations which are important to identify. First member 37 begins as a substantially rectangular and flat member of corrugated cardboard which should be visualized as including nine virtually identically sized generally rectangular panels **37*a* through 37*i*. The six substantially parallel broken lines which are illustrated denote fold lines so as to create the previously described center panel and depending sides. Consequently, the center panel of first member 37 when it is folded and in its ready-to-assemble form it will include individual panels 37*d*, 37*e*, and 37*f*. Panels 37*a*, 37*b* and 37*c* are folded in a manner so as to create a first side wall and the opposite side wall is created by a folded arrangement of individual panels 37*g*, 37*h* and 37*i*. The precise direction of each fold is illustrated in FIG. 5. Further, second member 38 of top support 22 is arranged and folded in the identical fashion with one exception. That one exception involves the location of clearance holes 43 and 44 relative to clearance holes 45 and 46. As is to be understood and as illustrated in FIG. 2, these four clearance holes are aligned with each other so as to receive therethrough plugs 25 and 26. Plug 25 extends through clearance holes 43 and 45 and thereafter through gasket 31 into internally threaded opening 47 in the top surface of water heater 21. Plug 26 extends through clearance holes 44 and 46 and thereafter through gasket 32 into internally threaded opening 48 in the top surface of water heater 21. If the first and second members, 37 and 38 of top support 22, were merely laid on top of each other in order to create the top support, the two-hole pattern existing in panel 37*e* would be identical to the two-hole pattern existing in panel 38*e***. However, as previously described, once the first and second members are folded, they are turned relative to one another at 90 degrees and consequently the two-hole pattern in each member must be changed so as to be in alignment *after* the 90 degree turn.

Referring to FIG. 4, first member 39 and second member 40 are not only virtually identical to each other, but are also identical to the size, shape, configuration and arrangement of members 37 and 38. The only real difference between first member 39 and first member 37 are the presence of clearance holes 43 and 44. Similarly, the only real difference between second member 40 and second member 38 are the presence of clearance holes 45 and 46. Although not integrally part of second member 40, styrene blocks 24 have been illustrated in broken line form so as to provide an indication of generally where those four blocks are positioned relative to the bottom support member. The substantially cylindrical shape of the water heater base is also illustrated in FIG. 4 in broken-line form. The general fold configuration of second member 40 is illustrated in FIG. 6 and in this illustration, the actual styrene blocks 24 are shown in solid line form, with a portion of the water heater still in broken-line form.

Referring to FIG. 5, the folded configuration of first member 37 is illustrated indicating the folds and arrangement of each of the nine panels. As can be seen, panels **37*b* and 37*c* provide a double thickness side wall as do panels 37*g* and 37*h*. Similarly, by the arrangement of folds, panels 37*a* and 37*d* create a double thickness portion adjacent panel 37*e*. On the opposite side of panel 37*e* another double thickness portion is provided by panels 37*i* and 37*f*. As should be understood a virtually identical construction exists for second member 38**.

Referring to FIG. 6, the folded configuration of second member 40 is illustrated. This folded construction indicates that a double thickness portion is provided by panels **40*a* and 40*d* on one side of center panel 40*e* while the opposite side of center panel 40*e* has a double thickness portion provided by panels 40*f* and 40*i*. The double thickness side walls are the result of an overlap of panels 40*b* and 40*c* on the left side and on the right side by panels 40*g* and 40*h***.

Although the crossed corrugated cardboard construction of top support 22 and bottom support 23 is important in the overall packaging concept of this invention and is important so as to provide an outer edge beyond the circumference of the water heater so that bands 29 and 30 can be securely tightened in place, the primary stabilizing and securing means is provided by center panels **37*e*, 38*e*, 39*e*, and 40*e*. As should be evident from the FIG. 2 exploded view illustration, center panel 37*e* is arranged in a crossing and overlapping fashion to center panel 38*e* and a similar crossing configuration exists between center panel 39*e* and center panel 40*e* of the bottom support. With regard to the center panel of each member, the following description which is provided will reference center panel 37*e*** and it is to be understood that this description applies identically for the other three center panels.

Center panel **37*e* is a two-part laminated construction including as its first layer the generally flat, single thickness of corrugated cardboard which is integral with the remaining panels 37*a* through 37*d* and 37*f* through 37*i*. In addition, panel 37*e* includes a reinforcing member 50 whose thickness is substantially the same as the thickness of a single cardboard panel so that when folded as is illustrated in FIG. 5, the three-sided form has substantially the same thickness throughout its entirety including both side walls and the top center panel. Due to the somewhat flexible or compressible nature of corrugated cardboard it is not an absolute requirement that the thickness of the reinforcing member be identical to the thickness of the base cardboard, only that it be somewhat similar so as to provide a relatively uniform thickness. This double thickness for each center panel is also illustrated in FIG. 6 with regard to center panel 40*e*. Once again, this center panel is a two-part lamination with one part corresponding to the normal single layer thickness of corrugated cardboard and the second layer corresponding to a reinforcing member 50. This second layer of material which creates member 50** has a degree of stiffness or rigidity which is greater than the stiffness or rigidity of the cardboard layer.

In the preferred embodiment, reinforcing member 50 is adhesively bonded to the cardboard layer lamination so that the reinforcing member maintains its position relative to its corresponding member (37–40) throughout the folding, assembly and banding operations. The reinforcing member is fabricated out of wood veneer but alternatively may be constructed from chip or particle board, plastic, or metal with the primary requirement that it provide sufficient strength and rigidity. The function of the reinforcing member is to transfer shock to the inner tank of the water heater. Gaskets 31 and 32 act as shock absorbers between the reinforcing member and the tank. In an alternative embodiment, when using a metal material for the reinforcing member 50, it is envisioned that tabs may be punched in the metal and then crimped into the supporting layer of cardboard like a barb or hook and maintain its relative position in that manner.

By using an overlapping and right-angled crossing configuration for the two reinforced panels **37*e* and 38*e* of the top member and by a similar overlapping and crossing configuration of the reinforcing panels 39*e* and 40*e* on the bottom support, the water heater is able to be securely and rigidly anchored to the composite package in a manner that is extremely safe and secure, extremely low-cost and efficient from a production standpoint and which provides desirable visibility to the enclosed appliance throughout all phases of shipping and handling. Due to the strength and rigidity provided by the top support and bottom support when banded together by bands 29 and 30, further packaging and protection is not required. However, from a cleanliness standpoint, it is desirable to encase the composite package assembly of FIG. 1** in a heat-shrinkable plastic wrap or in a stretch wrap. Such wrap maintains the visibility of the appliance so that the handlers can be made aware of any damage which might result. This shrink wrap plastic also provides an adequate barrier against dirt and debris which may otherwise collect on the appliance. A further function of the wrap is to hold any additional protective material in place. Such material may be added when peripheral devices encroach on the package window.

From the standpoint and manufacturing convenience, the fact that all four members, 37–40, are of virtually identical construction and are generally generic to any make or model of water heater greatly simplifies the preparation of the components for composite package 20. Although two folded members are used to create the top support and similarly the bottom support, a corrugated cardboard box open on one side provides an alternative design. The box is completed by laminating the reinforcing panels in an overlapping and crossing manner. With this alternative the double wall thickness is omitted and only a single panel is folded. While there are strength and rigidity trade-offs versus cost when evaluating this option, it is an option.

When dealing with a cylindrical appliance such as a water heater, the traditional packaging concept is to make the cartons well oversized so that the clearance space between the outer surface of the appliance and the inner surface of the package can be filled and buffered with various foam and cardboard inserts. An obvious problem with this design concept is the increased size of the container and the increased shipping and handling costs, not to mention the increased fabrication costs. With the present invention what is provided is what can be referred to as a "zero clearance" package where the space surrounding the appliance is kept to a minimum thereby reducing the overall package size and reducing shipping and handling costs.

It is to be understood that the first and second members of both the top and bottom supports when folded and arranged for assembly to the appliance have a generally square center area whose length on a side is only slightly larger than the diameter of the water heater. This zero clearance approach results in a most efficient and effective packaging concept. While there is some clearance space in the corners of the top and bottom supports due to the geometric realities of overlapping a square onto a cylinder or circle, those corner spaces are utilized by the bottom support by providing corner supports 24 at those locations. Additional protection is provided by bands 29 and 30 which may be plastic, metal, or wire and which are tightened into position by well known techniques and these bands provide for partial walls of protection for the received appliance.

So as to stabilize the top-heavy end of water heater 21 relative to shock effects received by the package, plugs 25 and 26 are received through the crossed, reinforced support panels 37*e* and 38*e* and are rigidly received by the internally threaded openings in the top of the water heater. Plugs 25 and 26 function as a transfer agent such that when the packaged assembly strikes ground any shock is transferred from the upper edge into the center of the tank. This attachment technique in combination with the bottom support and corner supports and in combination with bands 29 and 30 substantially minimizes any tendency in the water heater to tip over or incur any momentum which might result in tipping over.

The method of fabricating and assembling composite package 20 according to the present invention begins with preparing the four generally rectangular cardboard panels 37, 38, 39 and 40. Once these are cut to their appropriate and desired size, measurements may be made and score lines indicated for folding these members in the manner previously described so as to create a three-sided configuration. The laminated layer of reinforcing material which is placed contiguous with each of the sections 37*e*, 38*e*, 39*e* and 40*e* may be applied to the cardboard layer either before or after folding each member into its three-sided shape.

After folding and laminating with the reinforcing material, the two members which comprise top support 22 are turned relative to each other at approximately 90 degrees so that a generally square five-sided box-like structure is created. A similar assembly procedure is followed for the bottom support. With regard to the clearance holes which are disposed in the top support, these may either be drilled, punched or otherwise created at virtually any point in the fabrication and assembly sequence. It is believed that the most appropriate time to create the clearance holes is when the reinforcing material is laminated onto the cardboard. However, if desired for reasons of alignment or accuracy, these clearance holes could conceivably be created even after the two members are assembled to one another and prior to installation and attachment to the water heater.

The next step is to install the corner blocks 24 in the open corners of the bottom support 23. Thereafter, the water heater is set in place into the bottom support. The top support may either be attached with plugs 25 and 26 prior to setting the water heater into the bottom support or the top support may be attached thereafter. Once both supports are in position around the water heater, bands 29 and 30 encircle the entire assembly and are thereafter tightened in place. The final step is to cover the entirety of the package and water heater with heat-shrinkable, plastic wrap.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A composite package for appliances and the like comprising:

a top support including a first member having a reinforcing panel and a second member having a reinforcing panel, said reinforcing panels being of a material which is stiffer than the material of the remainder of the corresponding members, said reinforcing panels arranged in an overlapping relationship to each other;

a bottom support including a first member having a reinforcing panel and a second member having a reinforcing panel, said reinforcing panels being of a material which is stiffer than the material of the remainder of the corresponding members, said reinforcing panels arranged in an overlapping relationship to each other;

attachment means for attaching said top support to the appliance received within said composite package; and securement means for securing together in a stacked relationship said top and bottom supports with said appliance therebetween.

2. The composite package of claim 1 wherein said first member of said top support is fabricated of corrugated cardboard and folded in a plurality of locations along lines which are substantially perpendicular to the direction of said corrugations.

3. The composite package of claim 1 wherein said second member of said top support is fabricated of corrugated cardboard and folded in a plurality of locations along lines which are substantially perpendicular to the direction of said corrugations.

4. The composite package of claim 1 which further includes a plurality of corner braces disposed within said bottom support and arranged contiguous to said appliance when received within said composite package.

5. A zero clearance composite package for a water heater comprising:

a generally square, open, box-like cover attachable to the top of said water heater, said cover having a reinforcing layer which is of a material that is stiffer than the remainder of said box-like cover;

a generally square, open, box-like base suitably sized to receive the lower portion of said water heater therein, said base having a a reinforcing layer which is of a material that is stiffer than the remainder of said box-like base; and a plurality of bands, each suitably sized to extend completely around said cover and base when said water heater is disposed therebetween, said bands being suitably designed and arranged to be tightenable so as to draw said cover and base tightly toward each other against the opposite ends of said water heater.

* * * * *